United States Patent [19]

Gailey

[11] 4,426,822

[45] Jan. 24, 1984

[54] VERTICAL CEILING ASSEMBLY AND STRINGER THEREFOR

[75] Inventor: J. Lynn Gailey, Newton Falls, Ohio

[73] Assignee: Alcan Aluminum Corporation, Cleveland, Ohio

[21] Appl. No.: 438,533

[22] Filed: Nov. 1, 1982

[51] Int. Cl.[3] ..... E04C 2/42; E04B 5/52; E04B 1/60; E04B 2/66

[52] U.S. Cl. ..... 52/669; 52/484; 52/668; 52/772; 52/781

[58] Field of Search ..... 52/668, 484, 486, 39, 52/664, 665, 473, 489, 669, 666, 772, 781, 74; 403/346, 347, 207

[56] References Cited

U.S. PATENT DOCUMENTS

| | | | |
|---|---|---|---|
| 2,967,337 | 1/1961 | Hedrick | 52/473 |
| 3,044,586 | 7/1962 | Cassels | 52/668 |
| 3,182,773 | 5/1965 | Laaksonen | 52/666 |
| 3,265,420 | 8/1966 | Goodrich et al. | 52/699 |
| 3,321,882 | 5/1967 | Stahlhut | 52/484 |
| 3,742,671 | 7/1973 | Ellis | 52/666 |
| 3,755,988 | 9/1973 | van der Sluys | 52/664 |
| 3,911,638 | 10/1975 | Englund et al. | 52/489 |
| 3,969,870 | 7/1976 | Deaton | 52/669 |
| 4,364,215 | 12/1982 | Gailey | 403/347 |

FOREIGN PATENT DOCUMENTS

| | | | |
|---|---|---|---|
| 1335297 | 10/1973 | United Kingdom | 52/473 |

*Primary Examiner*—Alfred C. Perham
*Assistant Examiner*—Eugene R. Washington
*Attorney, Agent, or Firm*—Cooper, Dunham, Clark, Griffin & Moran

[57] ABSTRACT

In a ceiling assembly, a parallel array of horizontally elongated panels each having vertical major surfaces and a horizontal top flange and a plurality of spaced parallel horizontally elongated stringers extending above and transversely of the panels for supporting the panels, the stringers having horizontal flanges formed with slots in which the top edge portions of the panels are received. The slots are shaped to provide, in the stringer flanges, pairs of facing spring tabs to facilitate insertion of the top portions of the panels in the slots and to interlock with the panel top flanges.

6 Claims, 7 Drawing Figures

VERTICAL CEILING ASSEMBLY AND STRINGER THEREFOR

BACKGROUND OF THE INVENTION

This invention relates to suspended ceiling systems, and more particularly to so-called vertical ceiling systems, as well as to carrier or stringer elements for such system.

Suspended ceilings are widely used in interior constructions for aesthetic and other reasons. A typical suspended ceiling comprises an assembly of panels spaced below the true or structural ceiling of a room; and carried by horizontal stringers or like members which are themselves suspended from the true ceiling.

One form of suspended ceiling employs elongated metal panels extending horizontally in spaced parallel relation to each other with their major surfaces lying in vertical planes. Such a ceiling, sometimes termed a vertical ceiling (because of the vertical orientation of the panel major surfaces), has an unusual and attractive decorative appearance, and may also serve to conceal structures such as lights, sprinklers, speakers, ventilation equipment, etc., mounted in the space or plenum above the suspended ceiling, while permitting passage of illumination, water, sound or air between the panels.

Owing to the vertical orientation of the panels, the types of structures commonly employed to mount a conventional suspended ceiling of horizontal panels are inappropriate for use in a vertical ceiling system. It is therefore necessary to provide a special mounting or support arrangement for a vertical ceiling. Desirable criteria for such an arrangement include low cost and ease of installation as well as security and stability of support for the panels.

In U.S. Pat. No. 3,755,988, there is shown a suspended vertical ceiling system employing stringers of special configuration, which include paired panel-engaging projections that extend downwardly over a substantial portion of the width (vertical dimension) of the panels. U.S. Pat. No. 3,911,638 describes another type of vertical ceiling system, wherein the panels are suspended from the stringers by separate clips.

SUMMARY OF THE INVENTION

The present invention broadly contemplates the provision of a vertical ceiling assembly including an array of spaced parallel horizontally elongated panels each having opposed major surfaces oriented vertically and a longitudinal horizontal flange extending along its top edge, and a plurality of spaced parallel horizontally elongated stringers extending above and transversely of the panels for supporting the panels, wherein the stringers have longitudinal horizontal flanges each formed with a downturned outer margin and a succession of slots spaced along the length of the stringer for respectively receiving top edge portions of the panels extending beneath the stringer to secure the panels to the stringer. Each stringer advantageously has two opposed horizontal flanges as described, the slots respectively formed in the two stringer flanges being in register with each other such that each panel top edge portion is received in a slot in each stringer flange.

As a particular feature of the invention, each of the slots includes a stem portion extending inwardly from the edge of a stringer flange through and beyond the downturned margin thereof, and two branch portions diverging from the inner extremity of the stem portion for providing, in the stringer flange, a pair of facing spring tabs separated by the slot stem portion and each resiliently bendable about a horizontal axis parallel to the stem portion, such that an upper portion of a panel can be inserted in the slot stem portion with the panel top flange overlying one of the tabs and inserted through the slot branch portion adjacent that tab, the panel being then retained in the slot by the latter tab and by a facing edge of the other of the pair of tabs. Preferably, each branch portion of each slot forms an obtuse angle with the stem portion of the slot; and the downturned outer margin of each stringer flange is bent at an oblique angle to the horizontal.

In this assembly, the panels are mounted directly on the stringers, interlocking with the slots and spring tabs formed on the stringer flanges. The structure of the assembly is thus simplified, with attendant savings in material and labor costs, as compared with systems that require separate clips to attach the panels to the stringers. The paired spring tabs facilitate installation of the panels from beneath prepositioned stringers, since they yield to permit insertion of the top flanges of the panels into the slots and then return to hold the panels in place; moreover, when necessary a panel can easily be detached from a stringer by bending the adjacent tabs upwardly, i.e. to provide clearance for withdrawal of the panel from the slots. Since the stringers engage only the topmost portions of the panels, they are unobtrusive, enabling attainment of the desired aesthetic effect of an uninterrupted array of horizontally extending vertical surfaces.

Further features and advantages of the invention will be apparent from the detailed description hereinbelow set forth, together with the accompanying drawings.

DETAILED DESCRIPTION

Figure 1:
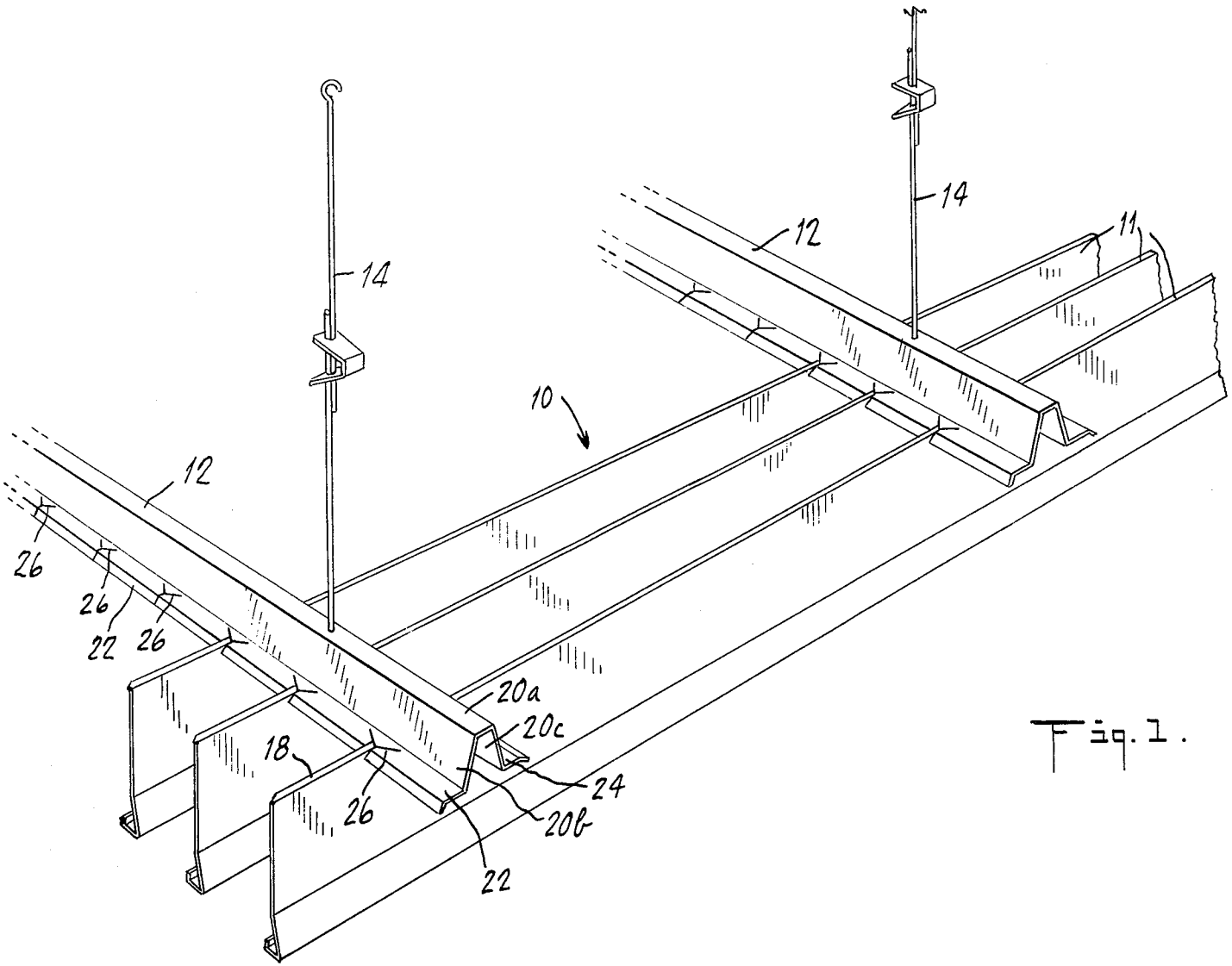
FIG. 1 is a perspective view, from above, of a vertical ceiling assembly embodying the present invention in a particular form.

Referring first to FIG. 1, the embodiment of the invention there illustrated is a suspended level vertical ceiling assembly 10 comprising an array of horizontally elongated ceiling panels 11 having vertically oriented major surfaces, and extending in spaced parallel relation to each other at a common level spaced below a permanent ceiling (not shown). The panels 11 are carried by a plurality of horizontally elongated carriers or stringers 12 which extend, in spaced parallel relation to each other, above and at right angles to the panels 11. Each panel thus extends beneath plural stringers and is connected to each of them, while each stringer overlies plural panels each connected to it. Further, each stringer is suspended from the superajacent permanent ceiling by a plurality of supports 14 spaced along the length of the stringer. The suspended vertical ceiling thereby provided may, for example, serve to mask equipment such as a sprinkler system disposed in the plenum or space between it and the permanent ceiling, while permitting downflow of water from the sprinkler system, and may be designed to present an attractive, decorative appearance.

Figure 3:
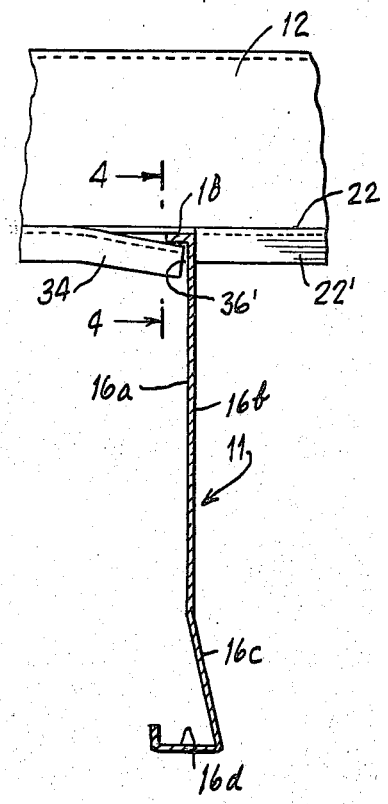
FIG. 3 is an elevational view taken along the line 3—3 of FIG. 2.

The panels 11 are formed e.g. from aluminum or other metal strip, and have opposed vertical flat major surfaces 16*a* and 16*b*. In its lower portion, each panel may be formed as shown in FIG. 3 with an outward bend 16*c* and marginal channel flange 16*d*. For purposes of protection and appearance, the panels may be painted or otherwise coated on all surfaces.

In accordance with the present invention, a narrow longitudinal horizontal flange 18 is formed along the top edge of each panel, extending for substantially the entire length of the panel in overhanging perpendicular relation to the vertical panel surface 16*a*. This panel top flange, as hereinafter explained, functions in conjunction with structural features of the stringers to enable the panels to be mounted directly on the stringers.

Each of the stringers 12 is a downwardly opening formed sheet metal channel member having a central web 20*a* and diverging legs 20*b* and 20*c*. Further in accordance with the invention, the lower portions of the two legs 20*b* and 20*c* are bent outwardly to provide, respectively, two opposed longitudinal horizontal flanges 22 and 24 extending in a common plane for substantially the entire length of the stringer. As indicated as 22' and 24', respectively, the outer margins of the two stringer flanges 22 and 24 are bent downwardly through an angle of less than 90° to the horizontal; these downturned outer margins extend for the full length of the stringer flanges.

As a particular feature of the invention, a succession of slots 26 are formed in each stringer flange 22 and 24 at regularly spaced intervals along the length of the stringer for receiving top edge portions of panels to secure the panels to the stringer. The slots respectively formed in the two flanges 22 and 24 of a stringer are in register with each other, so that the top edge portion of a panel extending beneath (and at right angles to) the stringer can be received in a slot in each stringer flange. Similarly, the plural stringers of the assembly 10 are suspended in such positions that the slots of each stringer are aligned with the slots of each other stringer in the assembly, to enable a panel to be secured to every stringer beneath which it passes. The stringers may be spaced apart by any convenient distance, e.g. up to about 7 feet.

Figure 2:
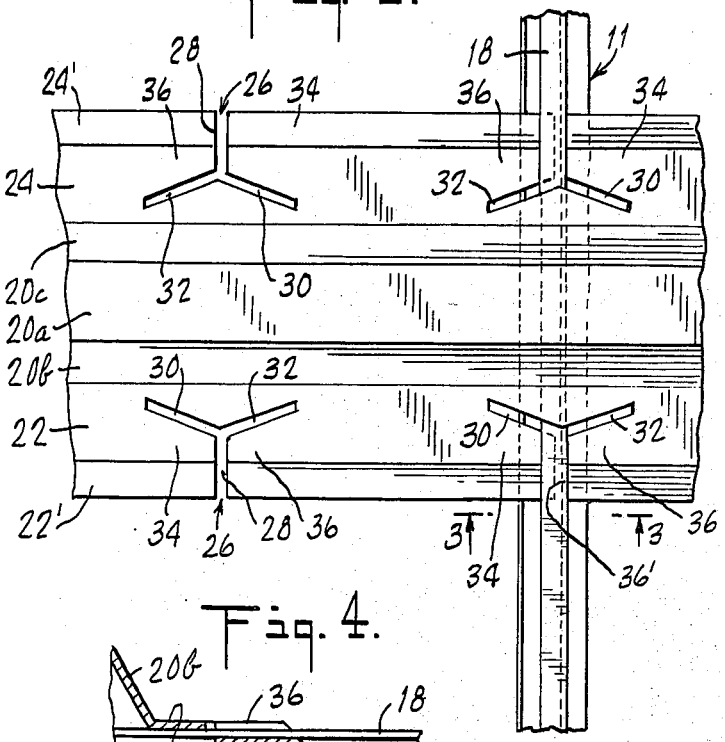
FIG. 2 is an enlarged fragmentary plan view of a portion of the assembly of FIG. 1.

Each of the slots 26, as best seen in FIG. 2, is Y-shaped, having a stem portion 28 which extends inwardly (in a direction perpendicular to the long dimension of the stringer) from the outer edge of a stringer flange 22 or 24 through and beyond the downturned margin 22' or 24' thereof, and two branch portions 30 and 32 diverging from the inner extremity of the stem portion for providing, in the stringer flange, a pair of facing spring tabs 34 and 36 separated by the stem portion 28 of the slot. In the illustrated embodiment, each of the two branch portions 30 and 32 of a slot forms an obtuse angle with the stem portion 28 thereof. The stringers 11 are fabricated of metal sheet of such gauge and properties as to be somewhat resiliently flexible; thus each of the tabs 34 and 36 is resiliently bendable about a horizontal axis parallel to the stem portion 28 of the slot defining the tabs.

Figure 4:
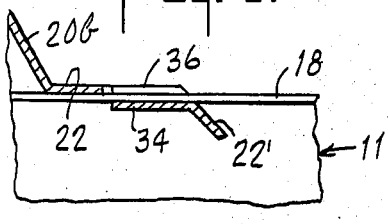
FIG. 4 is a fragmentary sectional view taken along the line 4—4 of FIG. 3.

This ability of the tabs to flex resiliently enables an upper portion of a panel 11 to be inserted (from beneath a prepositioned stringer) into a slot 26 such that the top flange 18 of the panel overlies one of the tabs 34 or 36 and extends through the associated branch portion 30 or 32 of the slot adjacent that tab. As indicated in FIGS. 2, 3 and 4, when a panel 11 is in place in its installed position on a stringer 12, with the panel top flange 18 projecting toward the tab 34 of one stringer flange 22 and the correspondingly positioned tab 36 of the other stringer flange 24, the panel flange 18 overlies the latter two tabs and extends through the slot branch portions 30 and 32 associated with those tabs so as to underlie the central portion of the stringer. The two tabs over which the flange 18 passes are deflected downwardly to accommodate the panel flange, but since they are in the nature of spring tabs, they exert an upward or restoring force that urges the flange 18 against the under surface of the central portion of the stringer. The upper vertical portion of the panel 11 extends through the stem portions 28 of the two slots in which the panel is received. Referring to the portion of the structure shown in FIG. 3, wherein the panel flange 18 overlies a tab 34 of flange 22, a facing edge of the other tab (edge 36' of tab 36, FIG. 3) engages the vertical upper portion of the panel to prevent the panel from moving laterally out of the slot. As will be apparent from FIG. 2, the same panel is similarly retained in the corresponding slot in flange 24 (wherein the panel flange 18 overlies tab 36) by the engagement of a facing edge of the adjacent tab 34 with the upper vertical portion of the panel.

The cooperating structural features of the panel and stringer of the invention thus provide a secure interlock between the spring tabs 34 and 36 formed in the stringers and the upper portions of the panels (including the panel top flanges 18) inserted in the slots 26. To install the assembly, the stringers 12 are first suspended or otherwise mounted in the illustrated spaced parallel arrangement. The panels are then individually mounted on the stringers. With a panel positioned beneath a stringer, a spring tab is bent up on one side of each slot 26 to enable insertion of the panel flange 18 over the spring tab on the other side of the slot, after which the initially displaced tab is released to spring back into a position in which its edge retains the panel in the slot. This procedure is repeated for both slots at the intersection of each panel and each stringer until all the panels have been installed. Owing to the symmetrical arrangement of the facing tabs 34 and 36, each of the two tabs associated with a slot can be used either to support a panel top flange 18 or to perform the retaining function of the tab 36 in FIG. 3; hence each stringer can be oriented in either of two opposed directions without affecting the provision of a desired panel orientation, a consideration that simplifies stringer installation.

If it becomes necessary to remove a panel after installation, disengagement of the panel from a stringer can be readily accomplished by bending the tab 36 in FIG. 3 (and the corresponding tab of the other stringer flange) upwardly until it no longer blocks the panel upper portion, i.e. so that the panel flange 18 can be slipped out of the slot. It will be understood that the internal width of the slot stem portion 28 (measured between the facing edges of tabs 34 and 36) is sufficiently greater than the thickness of a panel 11 to afford clearance for the described bending of the tabs when a panel is positioned in the slot stem portion.

Figure 5:
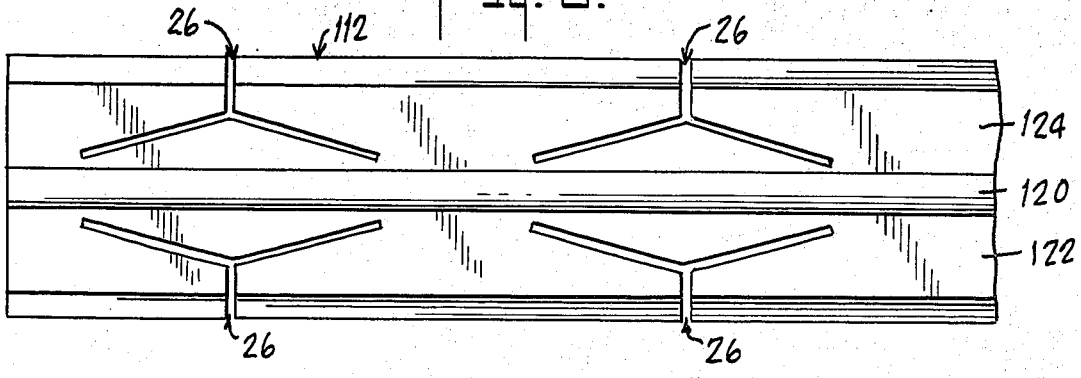
FIGS. 5, 6, and 7 are, respectively, plan, elevational, and sectional views of a modified form of the stringer of the invention.
Figure 6:
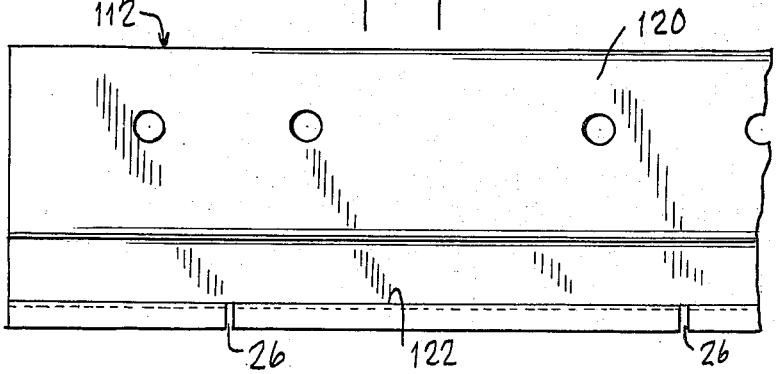
Figure 7:
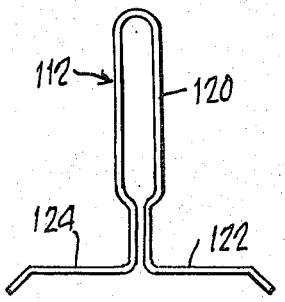

An alternative form of stringer embodying the invention is illustrated in FIGS. 5–7. The stringer 112 there shown has a central upstanding rib 120 (rather than being a channel member) but again is provided with two opposed longitudinal horizontal flanges 122 and 124 which are respectively identical to the flange 22 and 24 of the stringer 12 of FIGS. 1–4, having the same arrangement of slots 26, and may be used to mount the panels 11 in accordance with the invention.

By way of specific illustration, in an example of a stringer having the form shown in FIGS. 5–7, fabricated of sheet aluminum 0.032 inch thick, each horizontal flange 22 or 24 has a width of slightly less than $\frac{7}{8}$ inch, with a downturned outer margin 3/10 inch wide bent at an angle of 45° to the horizontal. Each slot 26 has a stem portion $\frac{3}{8}$ inch long (as measured in plan view) and an internal width of 1/16 inch. Each of the branch portions 30 and 32 is one inch in length and is oriented at an angle of 105° to the stem portion.

The spacing between adjacent slots 26 along the length of the stringer is selected in accordance with the desired spacing between adjacent panels 11 in the assembled ceiling. For example, the slots 26 may be spaced three inches apart on centers (measured between the geometric axes of the stem portions of adjacent slots), or 4 inches apart on centers.

It is to be understood that the invention is not limited to the features and embodiments hereinabove specifically set forth, but may be carried out in other ways without departure from its spirit.

I claim:

1. A ceiling assembly comprising (a) an array of spaced parallel horizontally elongated panels each having opposed major surfaces oriented vertically and a longitudinal horizontal flange extending along its top edge; and (b) a plurality of spaced parallel horizontally elongated stringers extending above and transversely of the panels for supporting the panels, (c) each of said stringers having two opposed longitudinal horizontal flanges each formed with a downturned outer margin and a succession of slots spaced along the length of the stringer for respectively receiving top edge portions of the panels extending beneath the stringer to secure the panels to the stringer, the slots respectively formed in the two stringer flanges being in register with each other such that each panel top edge portion is received in a slot in each stringer flange, (d) each of said slots including a stem portion extending inwardly from the edge of a stringer flange through and beyond the downturned margin thereof, and two branch portions diverging from the inner extremity of the stem portion for providing, in the stringer flange, a pair of facing spring tabs separated by the slot stem portion and each resiliently bendable about a horizontal axis parallel to the stem portion, such that an upper portion of a panel can be inserted in the slot stem portion with the panel top flange overlying one of said tabs and inserted through the slot branch portion adjacent said one tab, the panel being then retained in the slot by said one tab and by a facing edge of the other of said tabs.

2. A ceiling assembly as defined in claim 1, wherein each branch portion of each slot forms an obtuse angle with the stem portion of the slot.

3. A ceiling assembly as defined in claim 1, wherein the downturned outer margin of each stringer flange is bent at an oblique angle to the horizontal.

4. For use in a ceiling assembly including an array of spaced parallel horizontally elongated panels each having opposed major surfaces oriented vertically and a longitudinally horizontal flange extending along its top edge, a horizontally elongated stringer adapted to be disposed with other similar stringers in spaced parallel arrangement extending above and transversely of the panels for supporting the panels, said stringer comprising two opposed longitudinal horizontal flanges each formed with a downturned outer margin and a succession of slots spaced along the length of the stringer for respectively receiving top edge portions of the panels extending beneath the stringer to secure the panels to the stringer, the slots respectively formed in the two stringer flanges being in register with each other such that each panel top edge portion can be received in a slot in each stringer flange, each of said slots including a stem portion extending inwardly from the edge of a stringer flange through and beyond the downturned margin thereof, and two branch portions diverging from the inner extremity of the stem portion for providing, in the stringer flange, a pair of facing spring tabs separated by the slot stem portion and each resiliently bendable about a horizontal axis parallel to the stem portion, such that an upper portion of a panel can be inserted in the slot stem portion with the panel top flange overlying one of said tabs and inserted through the slot branch portion adjacent said one tab, the panel being then retained in the slot by said one tab and by a facing edge of the other of said tabs.

5. A stringer as defined in claim 4, wherein each branch portion of each slot forms an obtuse angle with the stem portion of the slot and wherein the downturned outer margin of each stringer flange is bent at an oblique angle to the horizontal.

6. A ceiling assembly comprising (a) an array of spaced parallel horizontally elongated panels each having opposed major surfaces oriented vertically and a longitudinal horizontal flange extending along its top edge;

(b) a plurality of spaced parallel horizontally elongated stringers extending above and transversely of the panels for supporting the panels, (c) each of said stringers having at least one longitudinal horizontal flange formed with a downturned outer margin and a succession of slots spaced along the length of the stringer for respectively receiving top edge portions of the panels extending beneath the stringer to secure the panels to the stringer, (d) each of said slots including a stem portion extending inwardly from the edge of a stringer flange through and beyond the downturned margin thereof, and at least one branch portion extending from the inner extremity of the stem portion, for providing, in the stringer flange, at least one spring tab resiliently bendable about a horizontal axis parallel to the stem portion, such that an upper portion of a panel can be inserted in the slot stem portion with the panel top flange overlying said one tab and inserted through the slot branch portion adjacent said one tab, the panel being then retained in the slot by said one tab and by a facing edge of the stringer flange along the slot stem portion.

* * * * *